United States Patent [19]

DiMatteo et al.

[11] 4,190,913

[45] Mar. 4, 1980

[54] INVALID BED ARRANGEMENT

[75] Inventors: Paul L. DiMatteo, Melville; Henry V. Diaferia, Brentwood, both of N.Y.

[73] Assignee: Solid Photography Inc., Melville, N.Y.

[21] Appl. No.: 893,467

[22] Filed: Apr. 4, 1978

Related U.S. Application Data

[63] Continuation-in-part of Ser. No. 806,777, Jun. 15, 1977, Pat. No. 4,085,471.

[51] Int. Cl.[2] ..... A61G 7/07

[52] U.S. Cl. ..... 5/81 R; 5/90

[58] Field of Search ..... 5/63, 66, 81 R, 90; 4/7, 134, 185 L; 297/DIG. 4, 10, 68

[56] References Cited

U.S. PATENT DOCUMENTS

| | | | |
|---|---|---|---|
| 3,510,886 | 5/1970 | Benoit et al. | 5/63 |
| 3,654,643 | 4/1972 | Clanan | 5/90 |
| 4,054,959 | 10/1977 | DiMatteo | 5/90 |

*Primary Examiner*—Casmir A. Nunberg

*Attorney, Agent, or Firm*—Max Fogiel

[57] ABSTRACT

An arrangement which allows patients confined to their beds, to use a toilet without leaving their beds or to be placed in a wheel chair. A sectionalized mattress is positioned in sequential steps so as to place the patient directly over a toilet or in a wheel chair without discomfort to the patient. The mattress, together with the patient, is positioned in a manner which allows the patient to use the toilet while sitting in an upright customary manner or in an inclined manner. The section of the mattress over the toilet is removed while the patient's weight is not directed thereon. Hygienic cleansing procedures are provided in conjunction with the toilet, and the patient is returned to a reclined position after repositioning the mattress and replacement of the section of the mattress that was removed to enable the patient to use the toilet. Replacement of that section of the mattress is carried out also while the patient's weight is not directed thereon. The mattress is positioned through a similar sequence of steps to place the patient directly into a wheel chair.

11 Claims, 17 Drawing Figures

FIG. 6
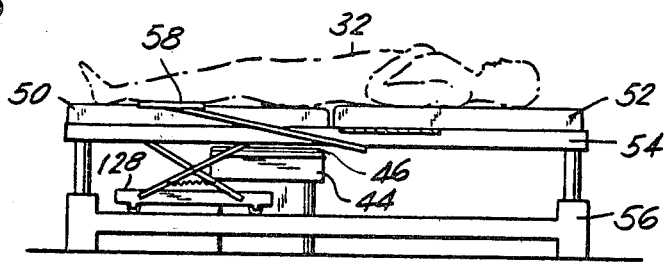
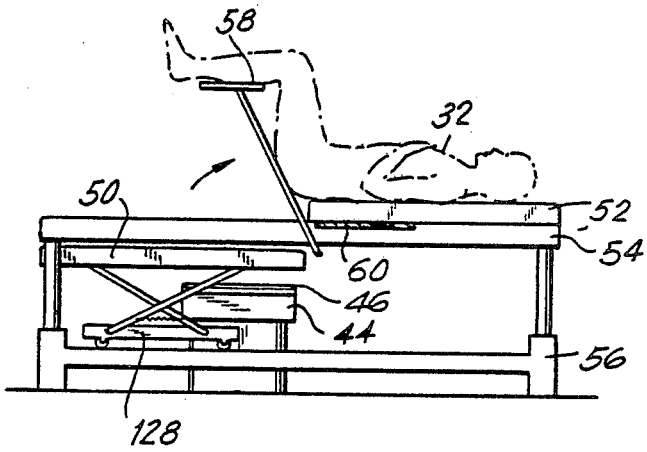
FIG. 7
FIG. 8
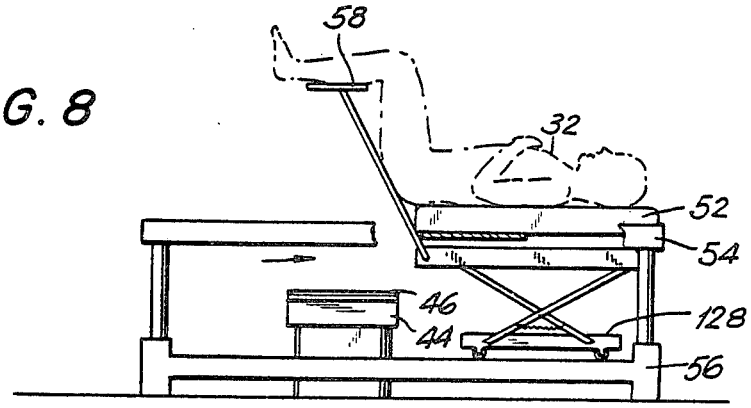

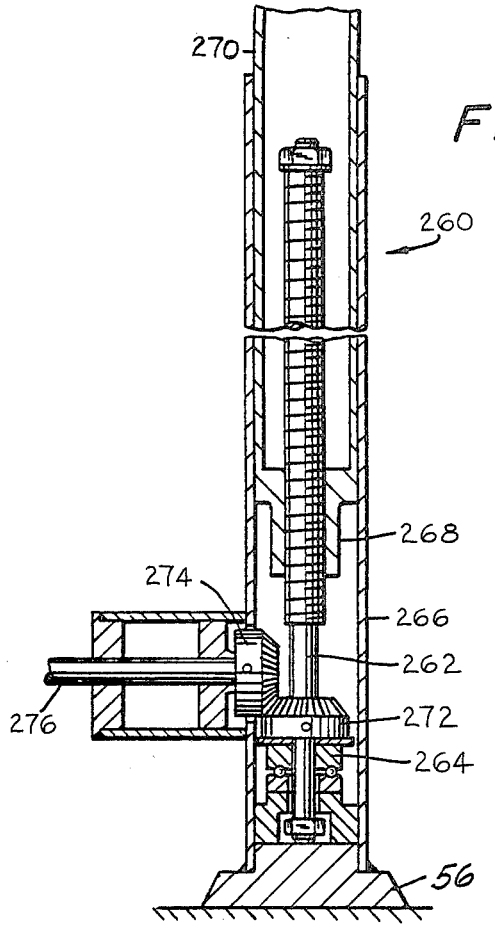
FIG. 15
FIG. 16
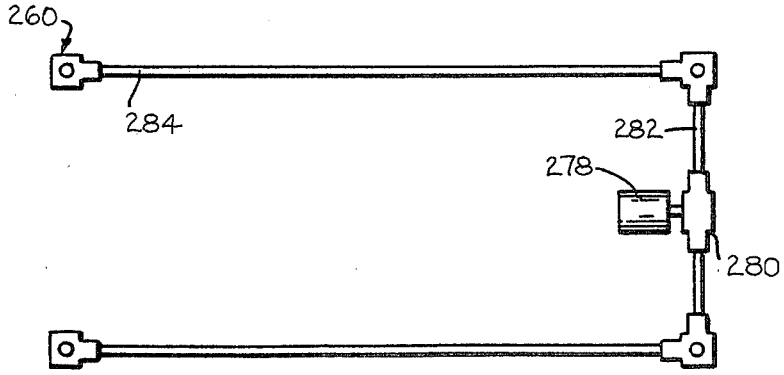

INVALID BED ARRANGEMENT

BACKGROUND OF THE INVENTION

This is a continuation-in-part of the parent application Ser. No. 806,777 filed June 15, 1977 now U.S. Pat. No. 4,085,471.

Toilet apparatus intended for persons generally confined to their bed, is already known in the art. However, the conventional apparatus which is available, heretofore, is not comfortable to the patient, does not allow the patient to use the toilet in the normal customary manner, and often requires that the patients leave their beds.

Conventional devices often used for patients are bedpans. These irritate the skin of the patient, and do not allow the patient to sit upright in the desired normal customary manner. Other conventional devices known in the art require that the patients be displaced relative to their beds, or leave their beds, in order to enable them to use the toilet in a seated normal upright position. Still other apparatus available in the art require that hospital aides, for example, exert considerable effort and carry out laborious procedures to apply the apparatus to the patient for use. This is often particularly uncomfortable to the patient, and requires that the aides possess substantial physical strength to carry and position the patient. The apparatus, furthermore, does not include provisions for hygienic cleansing and leaves the patient often in discomfort.

In addition to the disadvantages inherent in the conventional apparatus or hospital bed, these do not include provisions for transferring a patient from the bed to a wheel chair without requiring attendants to remove the patient from the bed and carry the patient into the wheel chair when the patient does not have, for example, sufficient muscle control or strength.

Accordingly, it is an object of the present invention to provide an arrangement which permits bedridden patients to use a toilet in a seated normally upright position, without leaving their beds.

It is another object of the present invention to provide a toilet arrangement which permits patients to use a toilet without leaving their beds, and without requiring that the patients exert substantial effort in becoming positioned over the toilet.

A further object of the present invention is to provide a toilet arrangement of the foregoing character which applies hygienic cleansing to a patient after use of the toilet.

It is also an object of the present invention to provide an arrangement in conjunction with the toilet apparatus, which enables a patient to be placed directly into a wheelchair from the bed, without requiring that the patient be carried into the wheel chair or that the patient take physical steps to be seated into the wheel chair.

It is a particular object of the present invention to provide the foregoing arrangement for placing a patient over a toilet or into a wheel chair, in which the patient cannot exert any movements due to, for example, lack of muscle control or physical strength.

A still further object of the present invention is to provide an arrangement as described, which is simple in design, requires no special skill to use or operate, and may be maintained economically in service.

SUMMARY OF THE INVENTION

The objects of the present invention are achieved by providing an arrangement in which the patient's mattress is subdivided into essentially two sections, a head section and a foot section. To place the patient over a toilet or into a wheel chiar, the head section is raised, and the foot section is moved along the length of the bed and underneath the head section. The movement of the foot section uncovers in this manner, a toilet bowl beneath the upper bed frame, and also allows a wheel chair to be positioned over the toilet bowl. The calves of the patient are raised by a bolster arrangement which supports the legs of the patient raised above the bed, with the knees bent.

After transfer of the foot section of the mattress beneath the head section, the latter is lowered to an extent whereby the posterior of the patient is placed in direct contact with a conventional toilet seat. The patient can use the toilet by remaining in an inclined position, or the head section may be rotated to enable the patient to be seated on the toilet in the conventional manner. In the latter position, the patient is seated upright or erect with feet directed downward in the normal customary manner of using a toilet.

The arrangement in accordance with the present invention, also permits rolling a wheel chair directly beneath the patient and over the toilet bowl, and to manipulate the patient so as to become seated comfortably in the wheel chair, without requiring that the patient be lifted or slid off the bed and moved over to a wheel chair.

After the patient has completed use of the toilet, or is to be returned to the bed from a wheel chair, the mattress sections are positioned in the reverse manner, and the patient becomes located on the bed in an inclined position without requiring attendants to lift or otherwise move the patient.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 6–10 are schematic diagrams and show the relative positions of essential elements in carrying out the sequence of operations, in accordance with another embodiment of the present invention;

FIG. 15 shows in detail the elevator column;

FIG. 16 shows the arrangement of the elevators.

DESCRIPTION OF THE PREFERRED EMBODIMENTS

Figure 1:
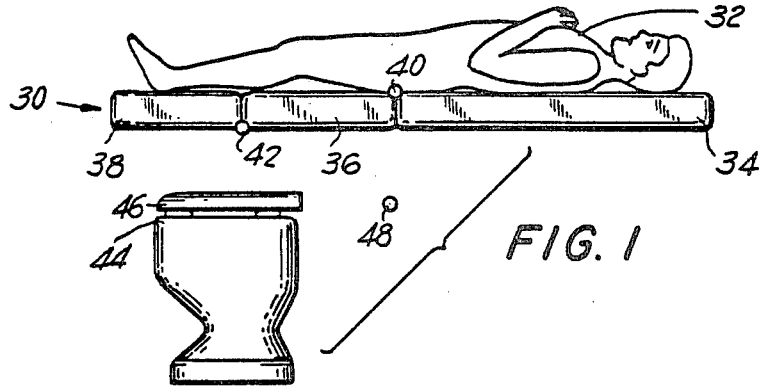
FIGS. 1 to 5 are schematic diagrams and show relative positions of the essential elements in carrying out the sequence of operations in accordance with one embodiment of the present invention.

Referring to the drawing, FIGS. 1 to 5 illustrate schematically the steps of moving a patient from a reclined position to a position in which the patient is seated over the toilet. In accordance with this arrangement of the present invention, a mattress 30 carrying a patient 32 is subdivided into essentially three sections comprised of a head section 34, central section 36, and foot section 38. The three sections are pivotable about pivots 40 and 42.

In the normal or usual position of the mattress 30, sections 34, 36 and 38 are coplanar, as shown in FIG. 1, and the patient may lie thereon in a reclined manner.

Figure 2:
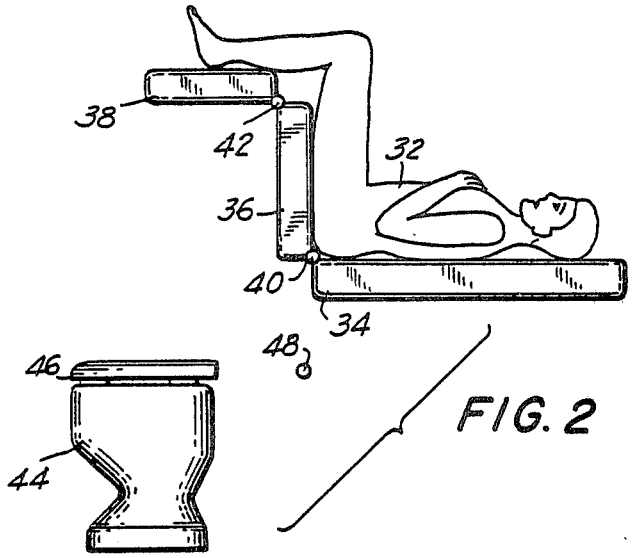

To carry out the procedure for placing the patient over a toilet 44 located beneath the mattress 30, the central section 36 is rotated relative to the head section 34 about pivot 40, into the position shown in FIG. 2. When section 36 is rotated substantially 90° about pivot 40 with respect to section 34, section 38 becomes rotated substantially 90° with respect to section 36, so that the patient lies in the position shown in FIG. 2 with feet supported upwards by the section 38, and head and back lying downward on section 34.

Figure 3:
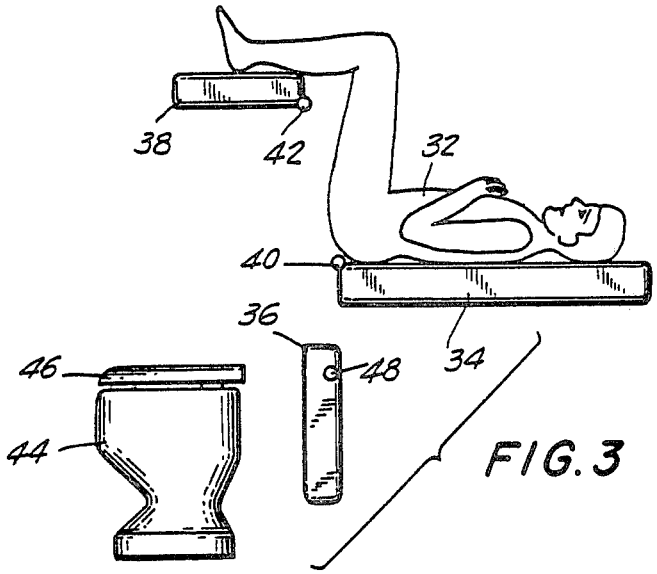

After the configuration of FIG. 2 has been attained, the central section of the mattress 36 is lowered to a position shown in FIG. 3, for the purpose of uncovering the area of the patient's posterior.

Figure 4:
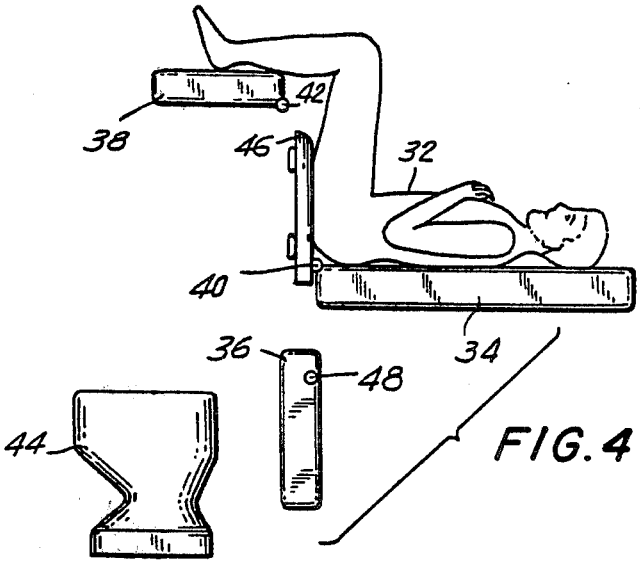

A toilet seat 46 resting normally on the toilet 44 is then rotated about a pivot 48 to bring the toilet seat 46 into contact with the patient's posterior as shown in FIG. 4. The linkage connecting the toilet seat 46 to the pivot 48 has been omitted from the schematic illustrations of FIGS. 1 to 5 for the purpose of clarity. The details of this linkage will be described subsequently.

Figure 5:
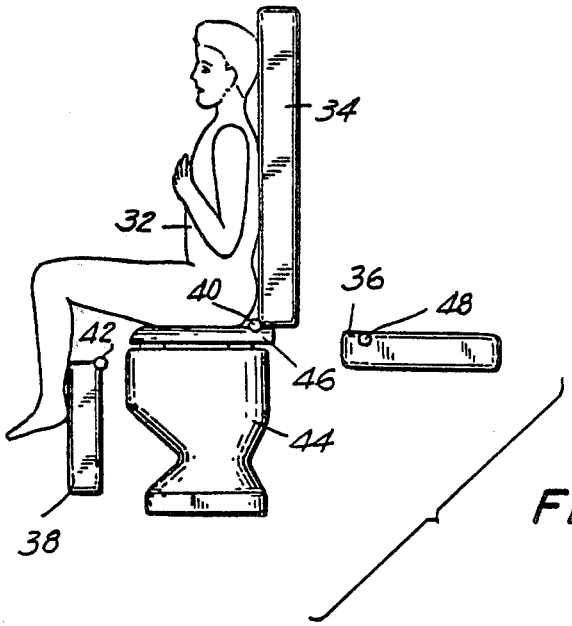

With the patient lying comfortably in the position shown in FIG. 4, the entire assembly of mattress sections 34, 36, 38, together with toilet seat 46, are rotated about the pivot 48 until the toilet seat 46 comes into contact with the top rim of the toilet 44, as shown in FIG. 5. In this position of FIG. 5, the patient is seated directly on the toilet in an upright and comfortable manner.

After the patient has terminated the use of the toilet, hygienic cleansing apparatus which may be installed directly within the toilet, may be actuated. Thereafter, the patient may be returned to a reclined position by passing through the sequence of FIGS. 4, 3, 2 and 1 in this specific reverse order.

It is an essential feature of the present invention to raise the legs of the patient as shown in FIGS. 2–4, also for the purpose of placing the patient into a wheel chair. When the patient is positioned as in FIG. 3, for example, it is possible to roll into place a wheel chair beneath the patient and over the toilet bowl, and thereafter manipulate the patient so as to bring the latter into an upright seated position directly on the wheel chair. Accordingly, the present invention does not only serve the function of seating the patient comfortably over a toilet bowl, but also seating a patient with ease and comfort in a wheel chair.

In a further embodiment of the present invention illustrated in FIGS. 6–10, the mattress of the patient's bed is subdivided into two sections 50 and 52. These mattress sections are supported on a main bed frame 54 which may be raised and lowered with respect to a base stationary frame 56. A bolster supporting member 58 is placed transversely across the bottom mattress section 50 and beneath the calves of the patient.

To raise the legs of the patient as shown in FIG. 7, the bolster member 58 is raised by being pivoted, for example, about a pivot 60. At the same time, the head mattress section 52 is raised to a level above the bottom mattress section 50. Raising of the mattress section 52 can also be carried out after the bolster 58 has been rotated into the raised position shown in FIG. 7.

After having attained the configuration of FIG. 7, the bottom mattress section 50 is moved to a location beneath the head section 52. During this movement of the mattress section 50, the patient remains in the position shown in FIG. 8 with the legs raised and supported by the bolster member 58.

Figure 9A:
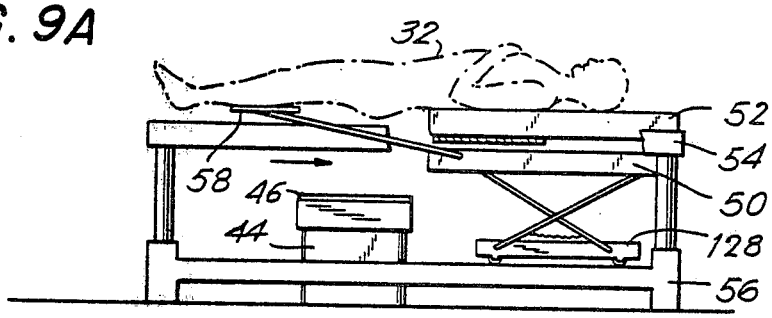

Thereafter, the supporting movable frame member 54 is lowered, together with the head section 52. In lowering the head section 52, the latter moves downward on the bottom section 50 located directly beneath section 52, until the top surface of the head section 52 is located substantially in the plane of the top surface of the toilet seat 46. The resultant positions of sections 50 and 52 are shown in FIG. 9A. The bottom mattress section 50 is supported by a frame structure, to be described, which permits this mattress section to be considerably lowered beneath the head section 52.

Figure 9:
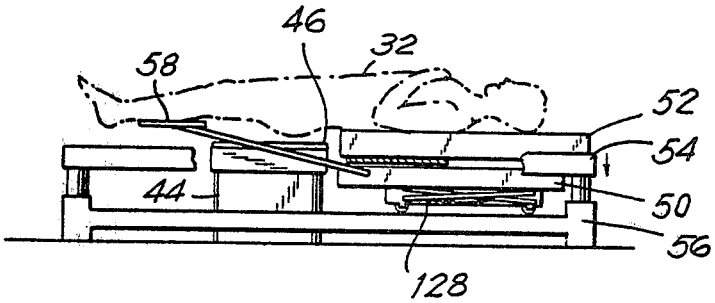

At the time that the head section 52 is lowered to attain the configuration of FIG. 9, the legs of the patient are permitted to drop by lowering the bolster member 58. The latter is lowered, in this manner, so that the patient will assume the inclined position shown in FIG. 9, in which the posterior of the patient is positioned directly in contact with the toilet seat, as shown in FIG. 9. This inclined position shown in FIG. 9, permits patients to remain inclined, if they are not comfortable when seated in the conventional manner over the toilet. In this inclined position of the patient, furthermore, the upper surface of the toilet seat takes the place of a conventional bedpan. However, with the arrangement of the present invention, it is not necessary to move the patient in the manner required when using a conventional bedpan, so as to bring the posterior of the patient over the bedpan. The back of the patient in the present invention, moreover, is also not bent, as it is when using a conventional bedpan. Accordingly, the configuration of FIG. 9 permits a patient after an operation, for example, to lie inclined while not experiencing the discomfort accompanying conventional bedpans.

Figure 10:
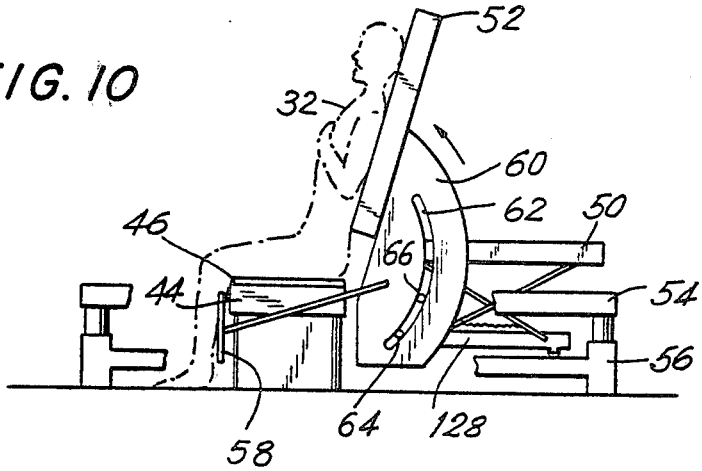

In the event that the patient is more comfortable in a seated position over the toilet, the head section 52 is moved out of the position shown in FIG. 9, and into the position shown in FIG. 10. The movement of this head section 52 is achieved by applying a rotational force to a guide member 60 attached to the head section 52 and having an arc-shaped slot 62.

Stationary pins 64 and 66 are spaced within the groove 62 and confine the path of the guide member 60 and hence the movement of the head section 52. The guide member 60 shown in FIG. 10, is omitted from FIGS. 6–9 for the sake of clarity. When raising the head section 52, moreover, the bolster 58 is further lowered to permit bending of the patient's knees, as shown in FIG. 10, to enable the patient to be comfortably seated.

The provision of rotating the head section 52 into the position shown in FIG. 10, is also an essential feature when positioning the patient so as to seat the patient in a wheel chair.

Figure 11:
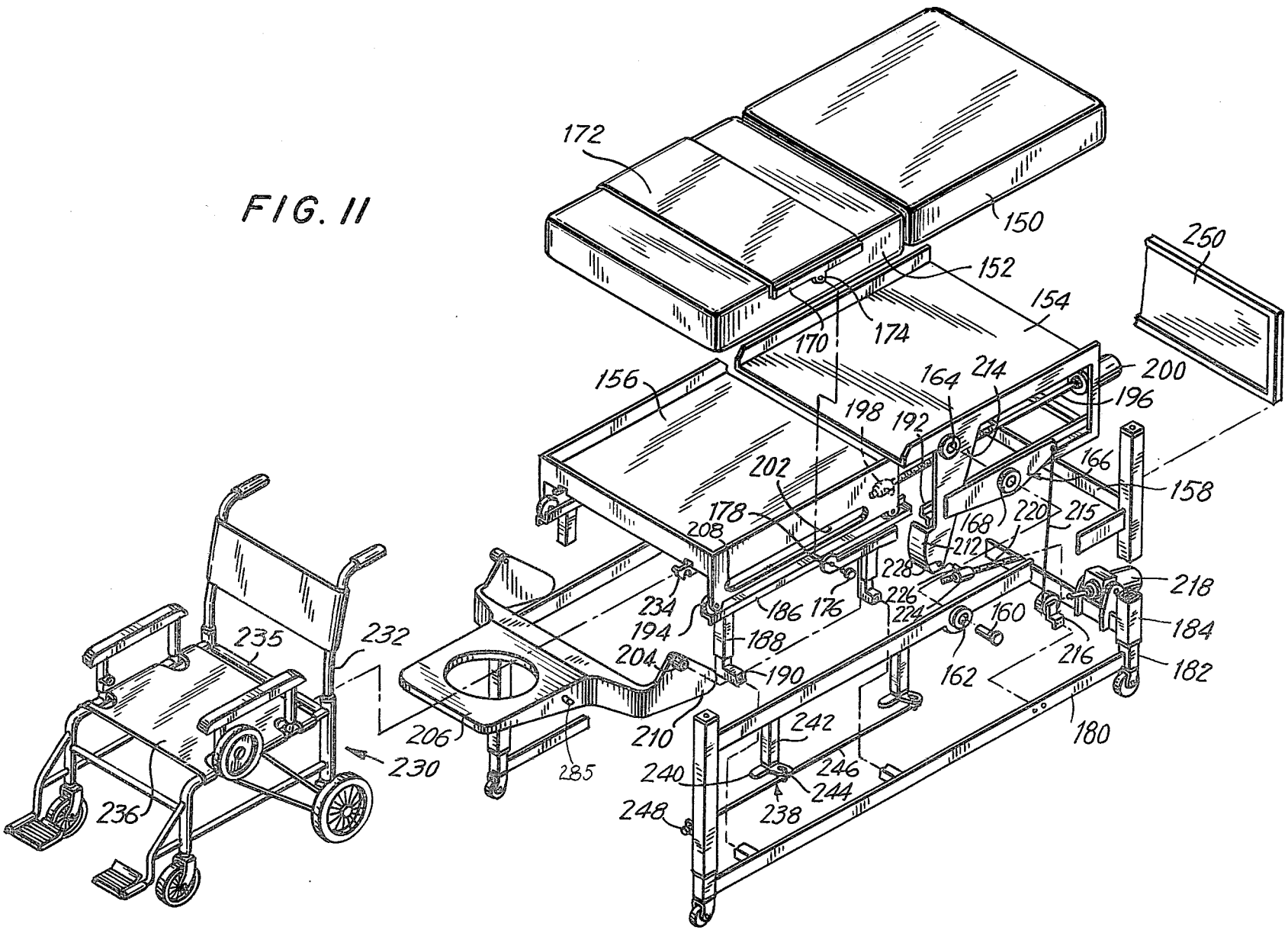
FIG. 11 is an exploded perspective view and shows the bed arrangement in accordance with the present invention.

In a still further embodiment of the present invention shown in FIG. 11, two mattress sections or cushions 150 and 152 are supported, respectively, in movable frames 154 and 156. Frame 154 is pivoted on a vertically movable support 158 through a bearing pin 160 passing through opening 162 in the frame 158 and opening 164 in the holding frame 154 which holds the mattress section 150.

Also pivoted about the pin 160, is a lever 166 which has a bearing hole 168 through which pin 160 passes. Thus, the bearing pin 160 forms a bearing surface for holding frame 154 and lever 166 by being passed simultaneously through openings 162, 164, and 168. One end of the lever 166 is pivotally connected to an end holding member 170 which holds a portion of stretched fabric placed across the mattress or bed section 152. This portion of fabric 172 serves as the bolster or calf support for the patient. The parts 170 and 172 form essentially the bolster or support arrangement 58. The end holding member 170 has an opening 174 through which passes a pin 176 for purposes of pivoting the member 170 on the lever 166. The pin 176 passes also through an opening 178 of the lever 166.

The frame 158 is telescopically received by the base frame 180 which is stationary on the ground. The stationary fixed base frame 180 has posts 182 at four corners which mate telescopically with tubular vertical members 184 attached to the frame 158. As a result of this telescopic arrangement, the frame 154 may be raised together with the supporting movable frame 158 when the tubular members 184 of this frame 158 are raised vertically with respect to the fixed posts 182.

Bed or mattress section 152 is held in the frame 156 which, in turn, is movably supported on track members 186. The tracks 186 are attached to vertical tubular members 188 which are telescopically received by L-shaped members 190 attached to the fixed base frame 180. Accordingly, the track members 186 are vertically movable with respect to the fixed frame 180, so that the bed or mattress section 152 may be raised or lowered together with the track members 186.

When holding frame 154 is raised as a result of raising the vertically movable frame 158 with respect to the fixed base frame 180, the track members 186 which remain stationary during such movement of the holding frame 154, may become aligned with corresponding track members 192 on the holding frame 154. When these track members 186 and 192 are aligned, the holding frame 156 together with bed section 152 may be rolled beneath the frame 154 by rollers 194 rolling from the track members 186 and onto track members 192. During this step of motion in which the frame 156 is rolled beneath the frame 154, a patient lying on the bed has his calves supported by the bolster part 172. The movement of holding frame 156 beneath the frame 154 is achieved by the rotation of a lead screw 196 within a bushing 198 which is pivotally attached to the holding frame 156 and threaded to receive the lead screw 196. The latter may be rotated by means of a motor 200. Thus, with rotation of the lead screw in the bushing 198, the lead screw draws the frame 156 towards the motor 200.

The holding frame 156 for bed section 152, has vertical sides provided with slots 202 which receive hub-shaped bearing elements 204 mounted on a toilet seat 206. These bearing elements 204 on the toilet seat ride within the slots 202 during the motion when the holding frame 156 is rolled beneath the frame 154. Near the end of travel of the frame 156 beneath the frame 154, the bearing elements 204 are engaged by the ends 208 of the slots 202. The toilet seat 206 has a cam-shaped portion 210 which bears against a corresponding bearing surface 212 of an arm extension 214 which is part of the holding frame 154. With the surface portion 210 of the toilet seat bearing against the corresponding surface 212 of the arm 214, the toilet seat will be pivoted upward when the bearing elements 204 are abutted by the ends 208 during the end portion of travel of the frame 156 beneath the frame 154. When the toilet seat 206 becomes thus pivoted or rotated upward at the end of motion of the frame 156 when being moved beneath the frame 154, the toilet seat is placed against the posterior of the patient resting on the bed.

Whereas one end of the lever 166 is connected to the holding end member 170, the othr end of the lever 166 is connected by means of a cable 215 to the fixed base frame 180 through a bracket 216. When the holding frame 154 is raised by raising the vertically movable frame 158 with respect to the fixed base frame 180, the lever 166 pivoted on the pin 160 through the frame 158, is also raised. With the raising of the lever 166 in this manner, tension in cable 215 results, and this tension causes the lever 166 to pivot about the pin 160 and thereby rotate the bolster fabric portion 172 so as to raise the calves of the patient. The purpose of raising the calves of the patient is to enable placement of the toilet seat 206 against the posterior of the patient while the latter is reclined on the bed.

After the toilet seat 206 has been placed against the posterior of the patient, the frame 158 is lowered together with the holding frame 154 and the frame 156 on the track members 192 within the frame 154. As a result of this lowering motion, slack is imparted to the cable 215, which then permits the bolster frame portion 172 and lever 166 to be free to rotate about the pin 160. Bolster fabric portion 172 and lever 166 will not fall due to the slack to cable 215 because of the stop 285 located on toilet seat 206.

After the vertically movable frame 158 has thus been lowered again, motor 218 which is attached to said frame is operated to turn lead screw 220 within bushing 224 which is pivotally attached to the end of arm 214. Thus, the bushing 224 has a pin member 226 passing into a bearing hole 228 in the arm 214. As a result of turning the lead screw 220, the bushing 224 advances on the lead screw towards the motor 218 and thereby rotates the holding frame 154 about the pivot pin 160 passing through the opening 164. With such rotation of the frame 154, the back of the patient is moved upright while his feet and calves are permitted to drop downward in view of the slack in the cable 215.

During the rotating motion of the frame 154 for the purpose of seating the patient in an upright manner, the cam surface portion 210 of the toilet seat 206 is retained in abutment against the bearing surface 212 of the arm 214, and as a result the toilet seat 206 and bolster frame portion 172 is rotated downward so that when the bed section 150 is substantially vertical, the toilet seat 206 is substantially horizontal and located over the toilet bowl stationed underneath it. The surface portion 210 on the toilet seat 206 is held against the bearing surface 212 of the arm 214, as a result of abutment of the bearing element 204 against the end 208 of the slot 202.

In addition to the bed of the present invention being usable with a toilet seat and bowl, the bed may also be used for purposes of placing the patient into a wheel chair 230. To place a patient into this wheel chair, the latter is rolled over the toilet seat 206 with the back rest 232 removed. The holding frame 156 is provided with latching elements 234 which latch onto the cross bar 235 on the wheel chair. With the seat 236 of the wheel chair covering the seat 206 for the toilet, the wheel chair is manipulated in the same manner as the toilet seat, and when the movable frame member 154 is pivoted or rotated upwards for purposes of seaing the patient in an upright manner, the patient becomes seated directly into the wheel chair.

In the description of the present invention to this point, the raising of the vertically movable frame 158 has resulted in raising the holding frame 154 with respect to the frame 156 except when frame 156 is on track 192. The two frames 154 and 156 are, therefore, displaced relative to each other when raising the movable frame 158 with respect to the base frame 180. In the course of examining patients, however, it is desirable to raise the entire bed above the conventional height of 24 inches, for example, to facilitate a physician or medical attendants to administer to a patient. For this purpose of raising the entire bed, which involves raising both frames 154 and 156 together, a bed elevation mechanism 238 is provided on the side of the bed frame 158. In this mechanism, an L-shaped rocker member 240 is pivotally supported by a column member 242. One portion of the rocker member 240 is slotted to receive a pin 244 on an actuating rod 246. When this actuating rod 246 is pulled by the knob 248 outward from the bed, the non-slotted arm of the rocker member 240 becomes rotated and placed underneath the track member 186. As a result of this arrangement, the track member 186 together with the frame member 156 becomes raised together with the frame 154 when the vertically movable frame 158 is raised. The raising of the track member 186 is made possible by the telescopic joining of the fixed L-shaped member 190 and the mating tubular member 188 which is fixed to the guide track 186. To return the mechanism 238 to its initial position in which only the frame 154 is raised with vertical upward movement of the frame 158, the rod 246 is pushed inward by the knob 248. The headboard 250 of the bed may be attached directly to the vertically movable frame 158.

Figure 12:
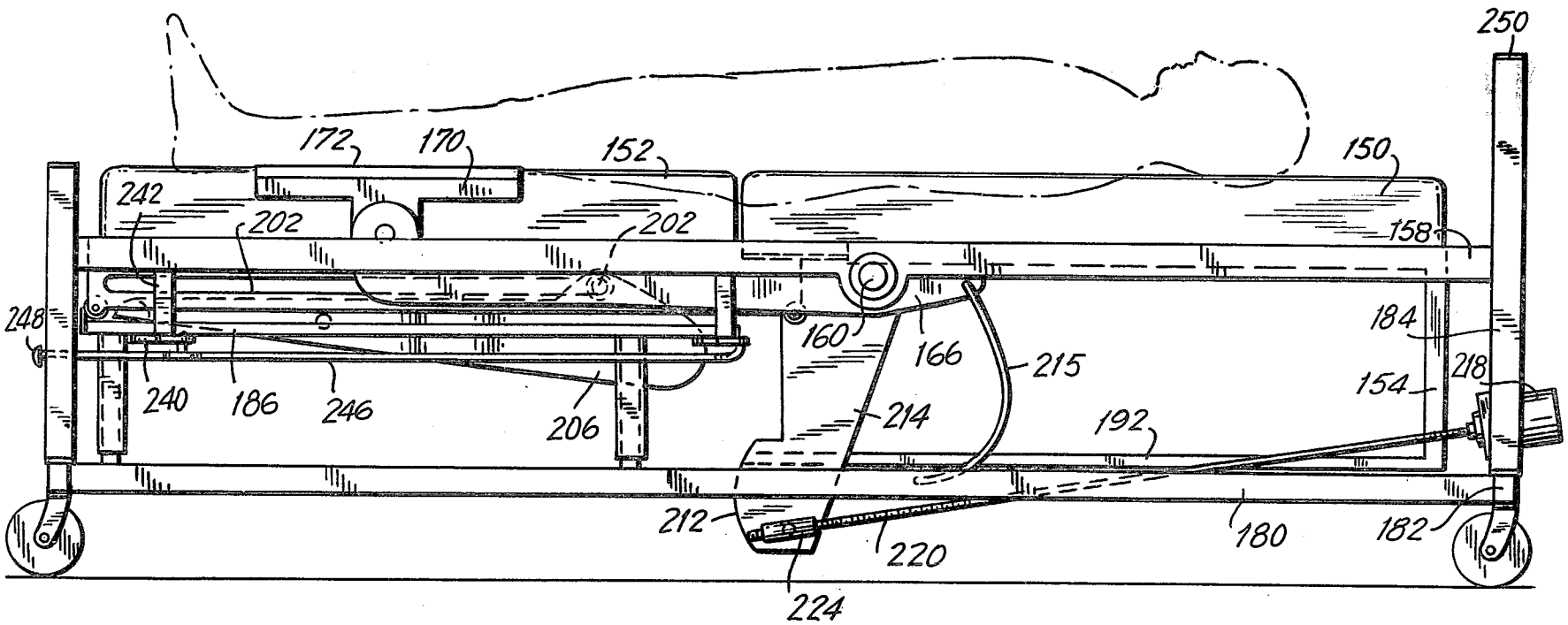
FIG. 12 is a side elevatonal view and shows the relative positions of elements of the bed arrangement of FIG. 11 when a person may be reclined thereon.

A side elevational view which shows the relationship of the assembled elements when the bed is in its initial position for a patient to rest on it when bed sections 150 and 152 are aligned, is shown in FIG. 12. This FIG. 12 illustrates the slack in the cable 215, when in this position, and the relationship of the toilet seat 206 with respect to the arm 214 attached to the holding frame 154. The lever 166 for the bolster parts 170, 172 is also shown in its initial position in this FIG. 12.

Figure 13:
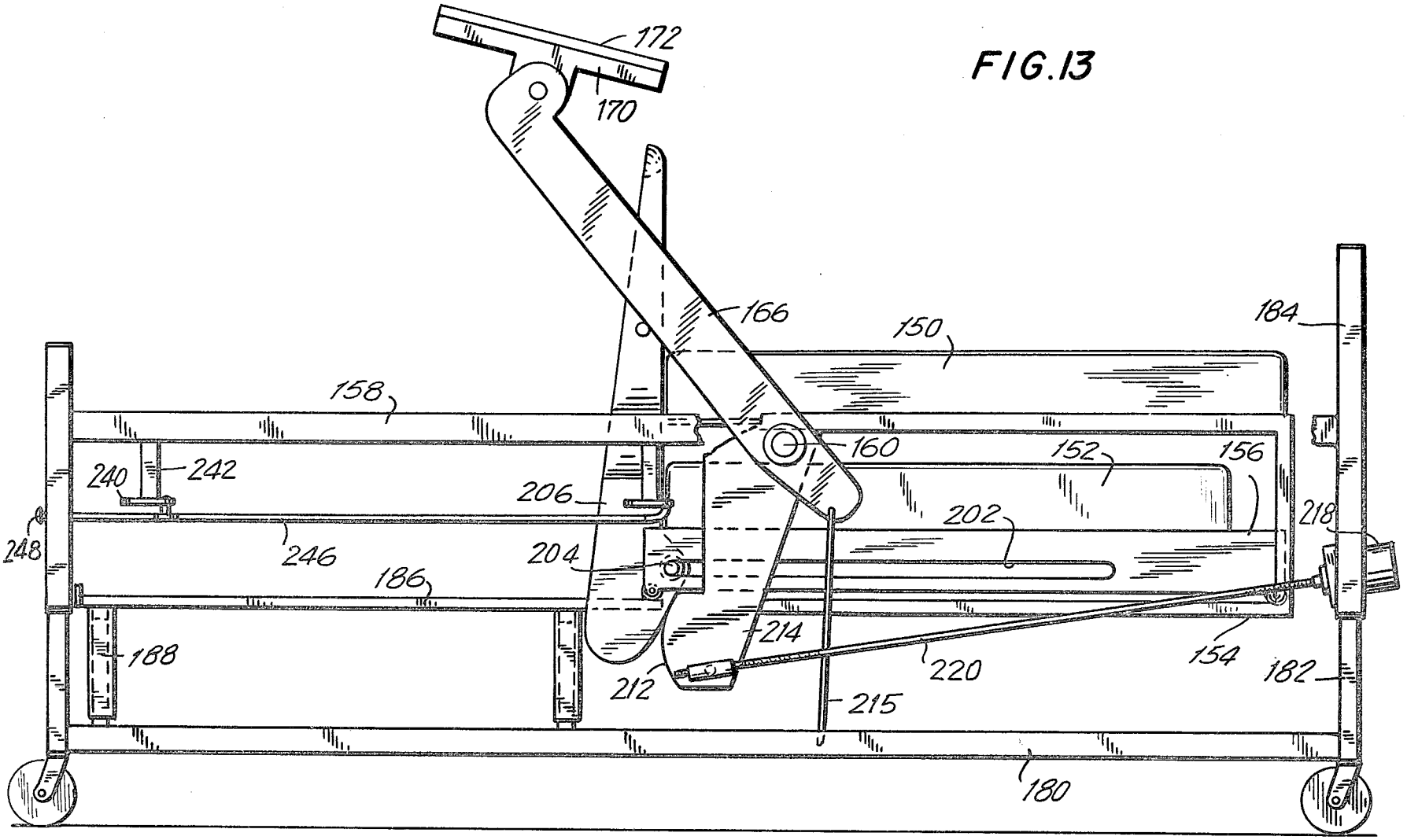
FIG. 13 is a side elevational view and shows the bed arrangement of FIG. 11 when one section of the bed has been moved underneath and inside the other section, and the bolster unit for supporting the calves of a person has been raised.

The positions of the operative parts of the bed arrangement when the frame 154 has been raised and the frame 156 has been located within the frame 154 and underneath the bed section 150, is shown in FIG. 13. This FIG. 13 is a side elevational view which shows the tensioning of the cable 215 and the raising of the bolster by the lever 166. The upward pivoting of the toilet seat 206 as a result of abutment of the bearing element 204 against the end of the slot 202 is also illustrated in this view.

Figure 14:
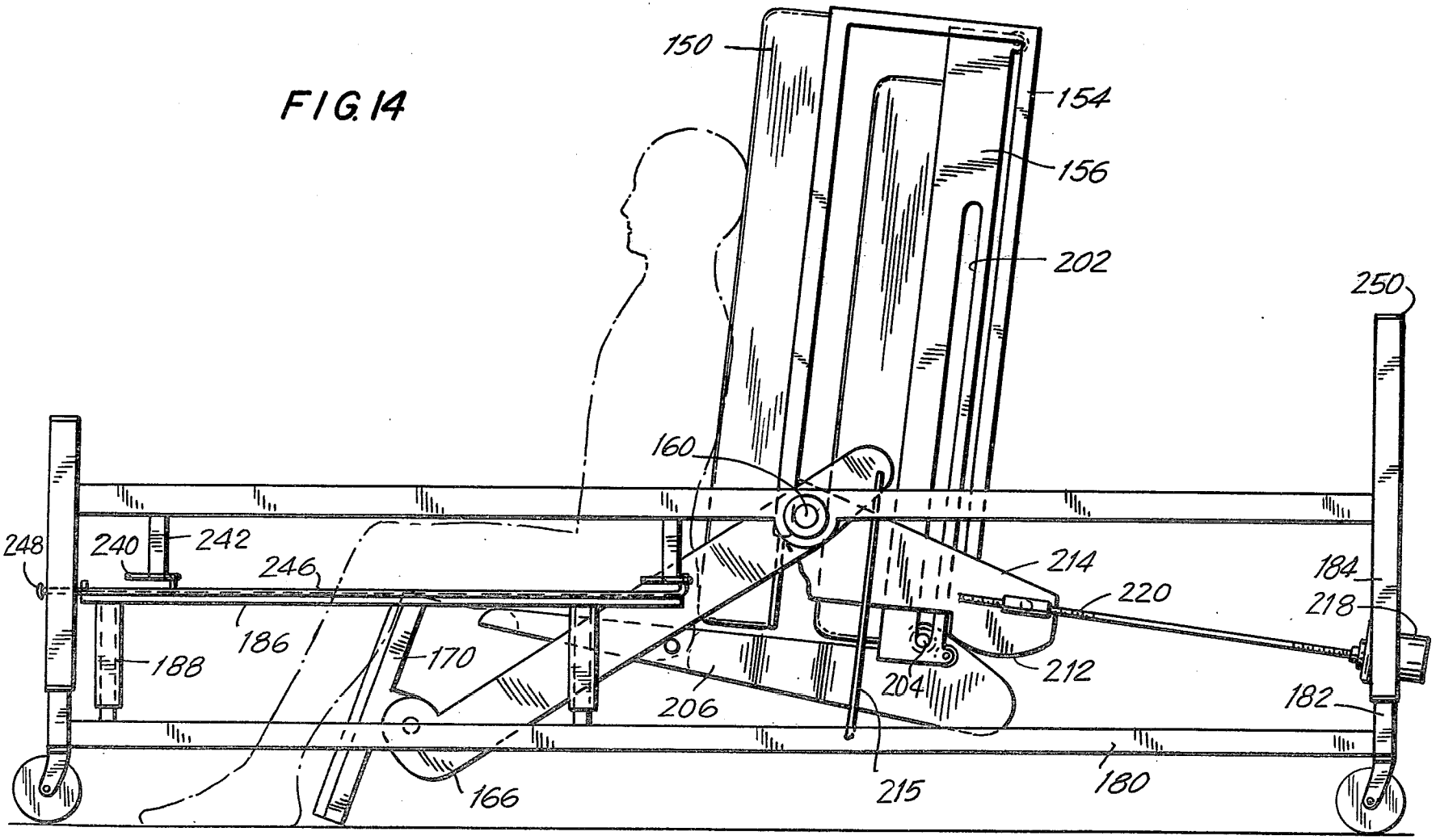
FIG. 14 is a side elevational view of the arrangement of FIG. 11 when a patient has been transferred from an inclined position to an upright seated position.

FIG. 14 shows the relative positions of the operative parts of the arrangement of the present invention, after the lead screw 220 has been driven to tilt the arm 214 so that the frame 154 together with bed section 150 become tilted upward for the purpose of placing the patient in an upright seat position. In this upright seated position of the patient, the latter is supported by the toilet seat 206 and the bolster end holding part 170 is underneath all spaced from the calves of the patient.

The raising and lowering of the movable frame 158 may be achieved by means of elevator columns 260 shown in detail in FIG. 15. In this elevator column, a threaded rod 262 is supported in a bearing 264 fixed to the stationary frame 180 by means of a substantially tubular sleeve 266. An internally threaded sleeve or nut 268 moves along the longitudinal axis of the rod 262 when the latter is rotated in the bearing 264. The top surface of the threaded sleeve or nut 268 supports a further tubular member 270 which surrounds the threaded rod 262. The tubular movable member 270 supports the frame 158. A bevel gear 272 is fixed to the threaded rod 262, and is in mesh with a further bevel gear 274 driven by a shaft 276. When the latter is rotated in a predetermined direction, for example, the threaded rod 262 is rotated correspondingly and the sleeve or nut 268 moves upward, and thereby raises the frame 158 supported by the tubular member 270.

FIG. 16 shows the arrangement in which the elevator columns 260 at each corner of the bed may be operated by a motor 278. The shaft of the motor is connected to a direction changing unit 280 having bevel gears which allow the axis of the motor shaft to be perpendicular to the axis of the shaft 282 driving the elevator column 260. Further bevel gears (not shown) in column 260 transmit the motion of the shaft 282 to shaft 284, for example. The direction changing unit 280 with bevel gears is commercially available and known in the art.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What we claim is:

1. An arrangement for transferring a person from a reclined position to an upright seated position comprising: means for supporting the back side of the person with the person's posterior at a first location; means for raising the calves of the person and bending the knees of said person; means for freeing substantially the posterior of said person; means for moving the person to an upright seated position and placing said person onto a seating member so that the posterior of said person is directly in contact with said seating member; said supporting means comprising a bed member subdivided into first and second sections; means for raising said first section above said second section; means for moving said second section beneath said first section for freeing the posterior of said person; means on said first bed section abutting said seating member when said second bed section is beneath said first section for moving said seating member against the person's posterior after freeing thereof; said second bed section having means for actuating said seating member against said abutting means on said first section when said second bed section reaches its end of movement beneath said first section so that said seating member is moved upward for placement against said person's posterior; and means for actuating said means for raising the calves when raising said first bed section.

2. The arrangement as defined in claim 1 including means for predetermined alignment of said first section and said second section after said first section has been raised for moving said second section under and into said first section.

3. An arrangement as defined in claim 1 wherein said first bed section has a bearing surface abutting a predetermined surface on said toilet seat for turning said toilet seat upward when said second section has been moved beneath said first section.

4. An arrangement as defined in claim 3 including a pin element on said seating member and slidably movable within a slot in said second section, said pin element being at an end of said slot when said predetermined surface on said seating member abuts said bearing surface on said first member.

5. An arrangement as defined in claim 1 including means for raising and lowering said first section and said second section simultaneously together.

6. An arrangement as defined in claim 1 including means on said second section for connecting a wheel chair to said second section and passing over said seating member.

7. An arrangement as defined in claim 1 including a fixed frame; a movable frame telescopically received by said fixed frame and supporting pivotally said first section and said calves raising means, said fixed frame supporting said second section.

8. An arrangement for transferring a person from a reclined position to an upright seated position comprising: means for supporting the back side of the person with the person's posterior at a first location; means for raising the calves of the person and bending the knees of said person; means for freeing substantially the posterior of said person; means for moving the person to an upright seated position and placing said person onto a seating member so that the posterior of said person is directly in contact with said seating member; said supporting means comprising a bed member subdivided into first and second sections; means for raising said first section above said second section; means for moving said second section beneath said first section for freeing the posterior of said person; means on said first bed section abutting said seating member when said second bed section is beneath said first section for moving said seating member against the person's posterior after freeing thereof; said second bed section having means for actuating said seating member against said abutting means on said first section; and means for actuating said means for raising the calves when raising said first bed section; said calves raising means comprising lever means pivoted on said first section; fabric means stretched over said second section for supporting the calves of said person; fabric holding means and pivotally connected to one end of said lever means; and cable means connected to the other end of said lever means, said cable means being tensioned when raising said first section for turning said lever means and raising said fabric means and thereby the calves of the person.

9. An arrangement for transferring a person from a reclined position to an upright seated position comprising: means for supporting the back side of the person with the person's posterior at a first location; means for raising the calves of the person and bending the knees of said person; means for freeing substantially the posterior of said person; means for moving the person to an upright seated position and placing said person onto a seating member so that the posterior of said person is directly in contact with said seating member; said supporting means comprising a bed member subdivided into first and second sections; means for raising said first section above said second section; means for moving said second section beneath said first section for freeing the posterior of said person; means on said first bed section abutting said seating member when said second bed section is beneath said first section for moving said seating member against the person's posterior after freeing thereof; said second bed section having means for actuating said seating member against said abutting means on said first section; and means for actuating said means for raising the calves when raising said first bed section; means on said second section for connecting a wheel chair to said second section and passing over said seating member; said wheel chair being turned with said seating member when said second section is moved under said first section for placing a person in said wheel chair.

10. An arrangement for transferring a person from a reclined position to an upright seated position comprising: means for supporting the back side of the person with the person's posterior at a first location; means for raising the calves of the person and bending the knees of said person; means for freeing substantially the posterior of said person; means for moving the person to an upright seated position and placing said person onto a seating member so that the posterior of said person is directly in contact with said seating member; said supporting means comprising a bed member subdivided into first and second sections; means for raising said first section above said second section; means for moving said second section beneath said first section for freeing the posterior of said person; means on said first bed section abutting said seating member when said second bed section is beneath said first section for moving said seating member against the person's posterior after freeing thereof; said second bed section having means for actuating said seating member against said abutting means on said first section; and means for actuating said means for raising the calves when raising said first bed section; means for raising and lowering said first section and said second section simultaneously together; said means for raising and lowering simultaneously said first and second sections comprising rocker arm means pivotable for engaging said second section prior to raising said first section.

11. An arrangement as defined in claim 1 including means for predetermined alignment of said first section and said second section after said first section has been raised for moving said second section under and into said first section; said first bed section having a bearing surface abutting a predetermined surface on said toilet seat for turning said toilet seat upward when said second section has been moved beneath said first section; a pin element on said seating member and slidably movable within a slot in said second section, said pin element being at an end of said slot when said predetermined surface on said seating member abuts said bearing surface on said first member.

* * * * *